US008414180B1

(12) United States Patent
Mattingly et al.

(10) Patent No.: US 8,414,180 B1
(45) Date of Patent: Apr. 9, 2013

(54) FLUID MIXING APPARATUS

(76) Inventors: Jackie R. Mattingly, Noblesville, IN (US); Robert M. Rolfes, Noblesville, IN (US)

( * ) Notice: Subject to any disclaimer, the term of this patent is extended or adjusted under 35 U.S.C. 154(b) by 685 days.

(21) Appl. No.: 12/704,626

(22) Filed: Feb. 12, 2010

(51) Int. Cl.
*B01F 7/20* (2006.01)

(52) U.S. Cl. ..... 366/247; 366/308; 366/325.93; 366/326.1; 366/329.1; 366/329.3; 366/605

(58) Field of Classification Search ..... 366/247, 366/308, 325.92, 325.93, 326.1, 329.1–329.3, 366/605
See application file for complete search history.

(56) References Cited

U.S. PATENT DOCUMENTS 448,375 A * 3/1891 Shepard ..... 366/325.8
1,436,172 A * 11/1922 Holmgren et al. ..... 366/251
1,698,402 A 1/1929 Harris
2,257,238 A 9/1941 Hexter
3,381,941 A * 5/1968 Gibson et al. ..... 366/308
4,422,770 A 12/1983 Geible
5,094,543 A 3/1992 Mursa
5,199,788 A 4/1993 Stallings
D438,109 S 2/2001 Vanderhoof et al.
6,419,385 B1 7/2002 Walls
D484,657 S 12/2003 Scolley et al.

* cited by examiner

*Primary Examiner* — David Sorkin

(57) ABSTRACT

A fluid mixing apparatus for mixing a fluid in a circular container includes a circular lid for engaging the open top container. A shaft is rotatably positioned through the lid and is rotatable about a shaft axis. A mixer is attached to the shaft adjacent one end for rotating with the shaft in a plane perpendicular to the shaft axis. The mixer receives the shaft. The mixer has a fixed portion and a hinged portion hingedly connected to the fixed portion. An agitator is mounted to the shaft for agitating a fluid when the apparatus is mounted in a container.

10 Claims, 6 Drawing Sheets

FLUID MIXING APPARATUS

BACKGROUND OF THE DISCLOSURE

FIELD OF THE DISCLOSURE

The disclosure relates to mixers and more particularly pertains to a new mixer for mixing a fluid in a circular container.

SUMMARY OF THE DISCLOSURE

An embodiment of the disclosure meets the needs presented above by generally comprising a fluid mixing apparatus configured to mix fluid in a cylindrical container having an open top, including a circular lid for engaging the open top. A shaft is rotatably positioned through the lid and is rotatable about a shaft axis. A mixer is attached to the shaft adjacent one end for rotating with the shaft in a plane perpendicular to the shaft axis. The mixer receives the shaft. The mixer has a fixed portion and a hinged portion hingedly connected to the fixed portion. An agitator is mounted to the shaft for agitating a fluid when the apparatus is mounted in a container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
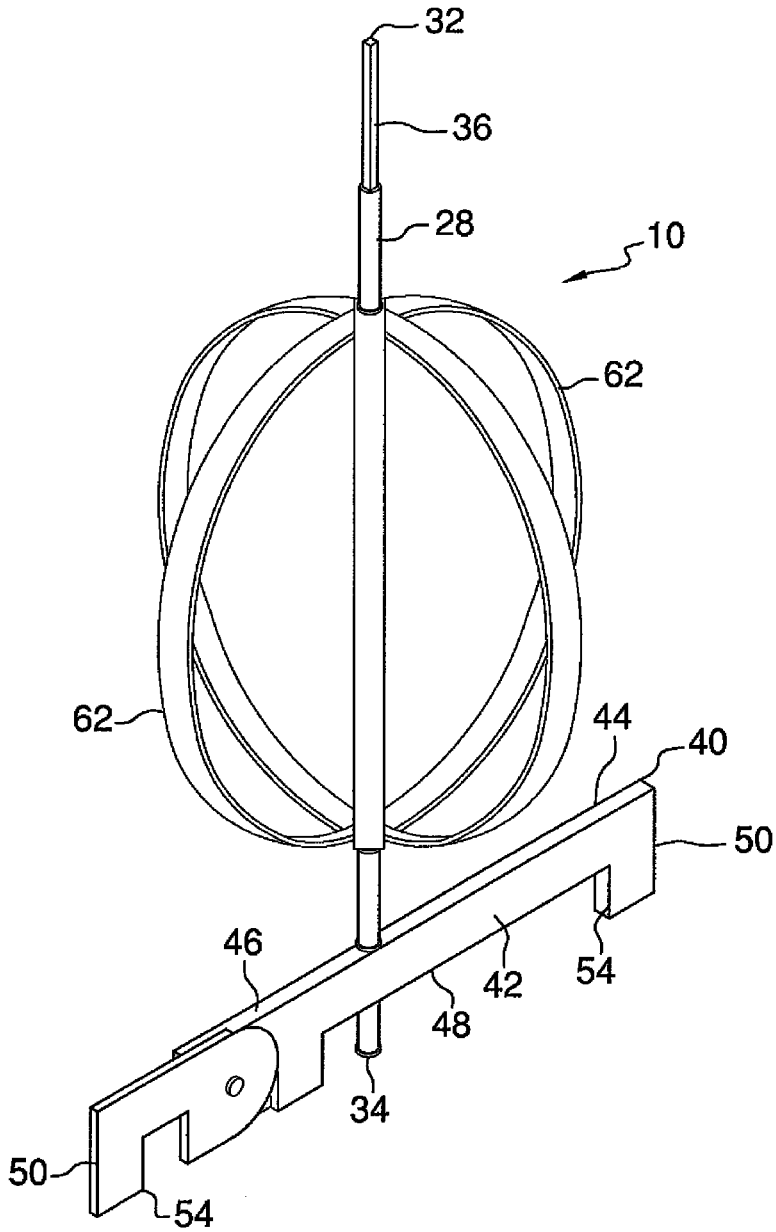
FIG. 1 is a front view of a fluid mixing apparatus according to an embodiment of the disclosure.
Figure 2:
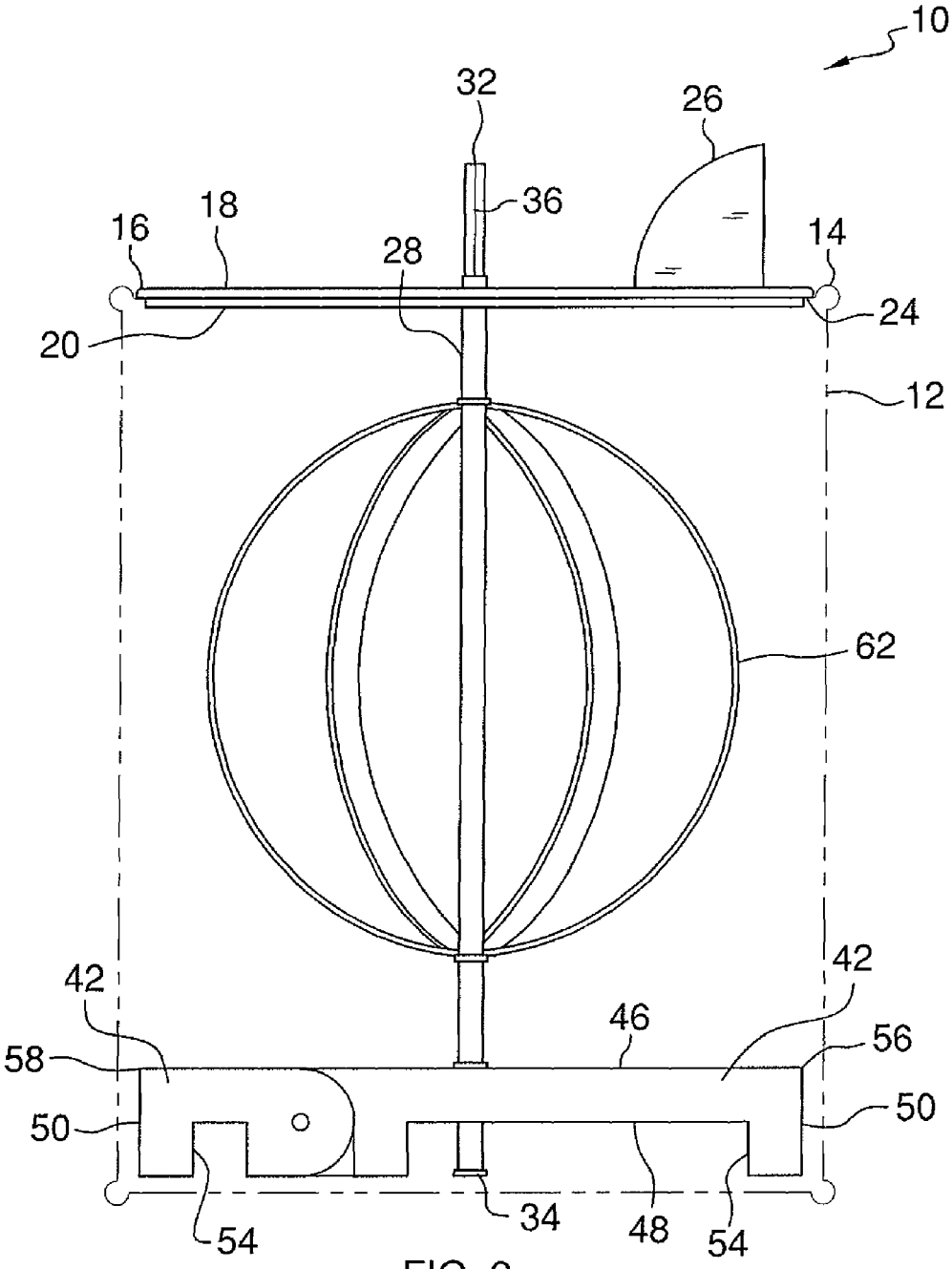
FIG. 2 is a front side view of an embodiment of the disclosure.
Figure 3:
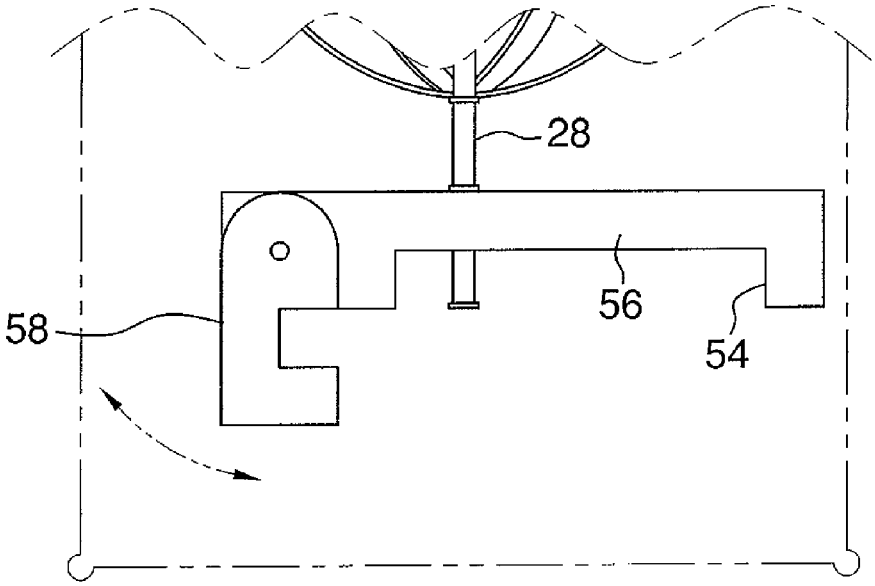
FIG. 3 is a partial front view of an embodiment of the disclosure.
Figure 4:
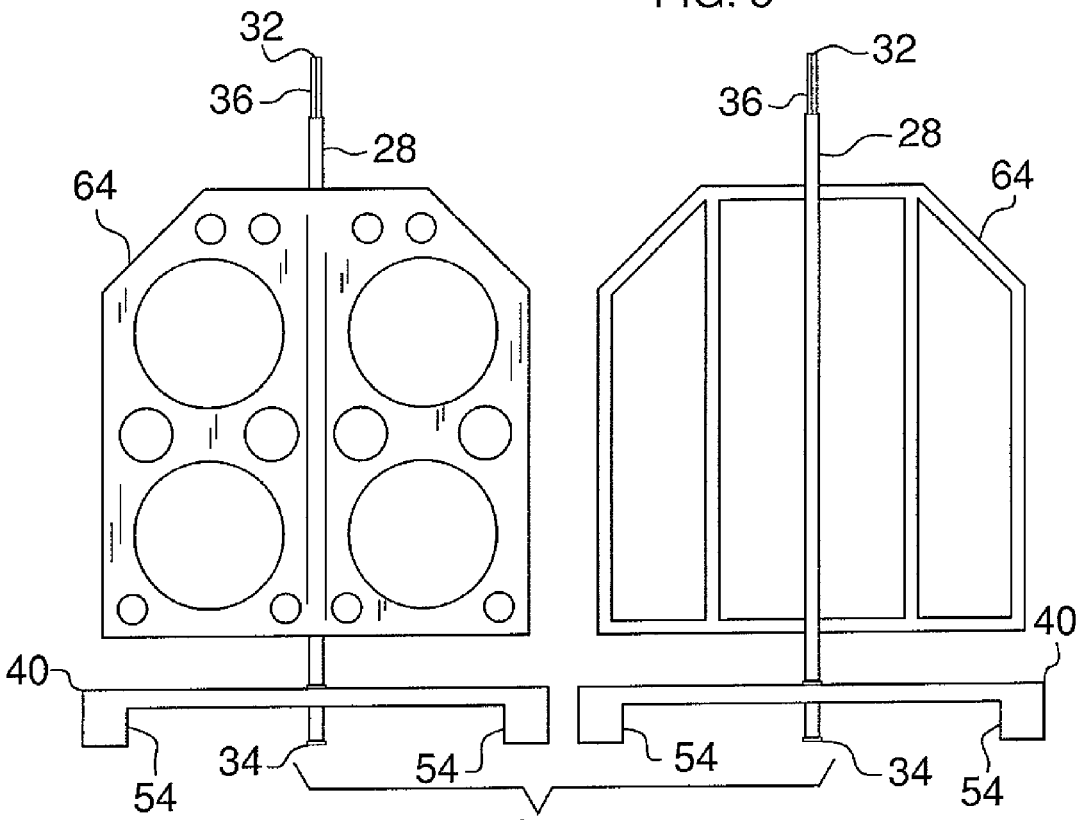
FIG. 4 is a front view of an embodiment of the disclosure.
Figure 5:
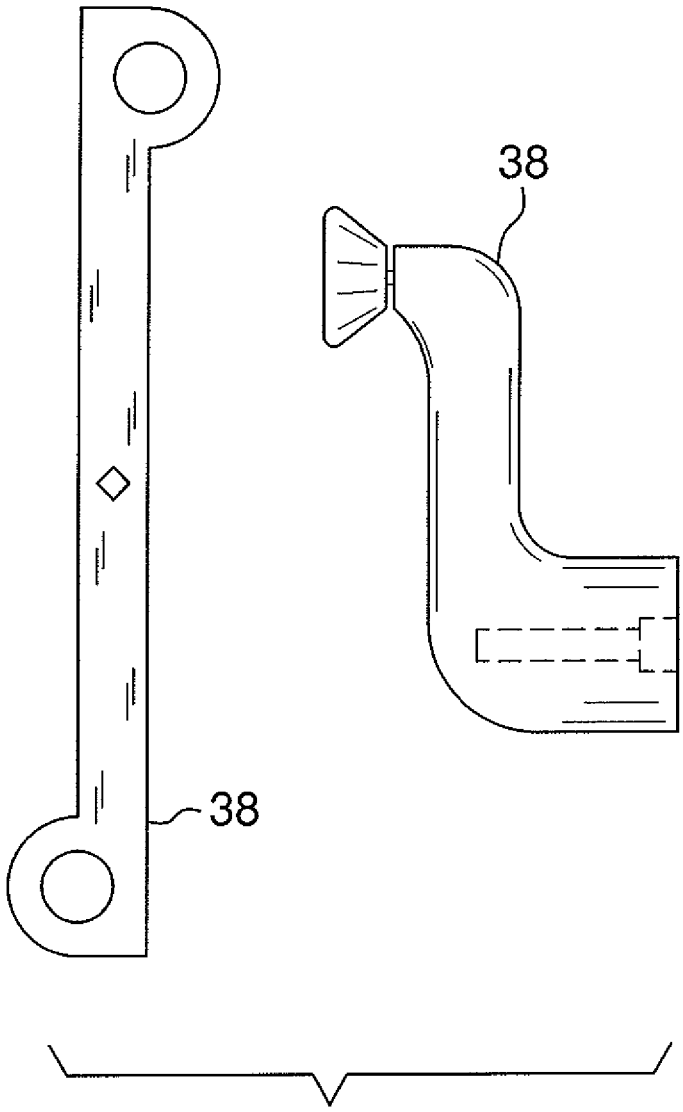
FIG. 5 is a front view of an embodiment of the disclosure.
Figure 6:
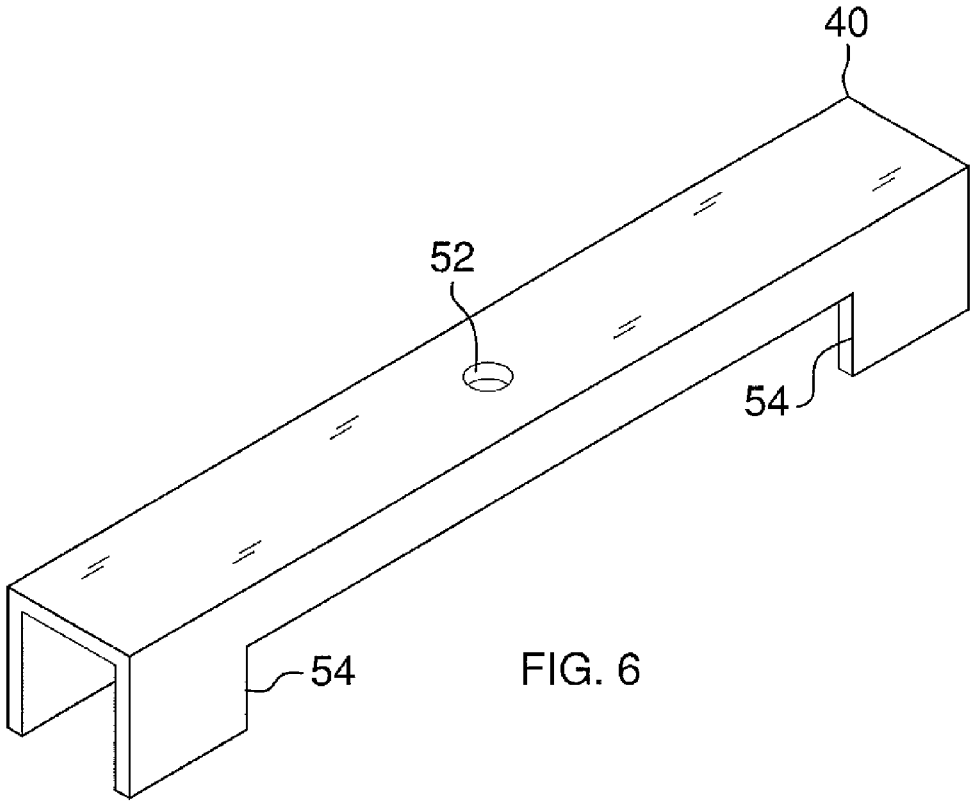
FIG. 6 is a front side view of an embodiment of the disclosure.
Figure 7:
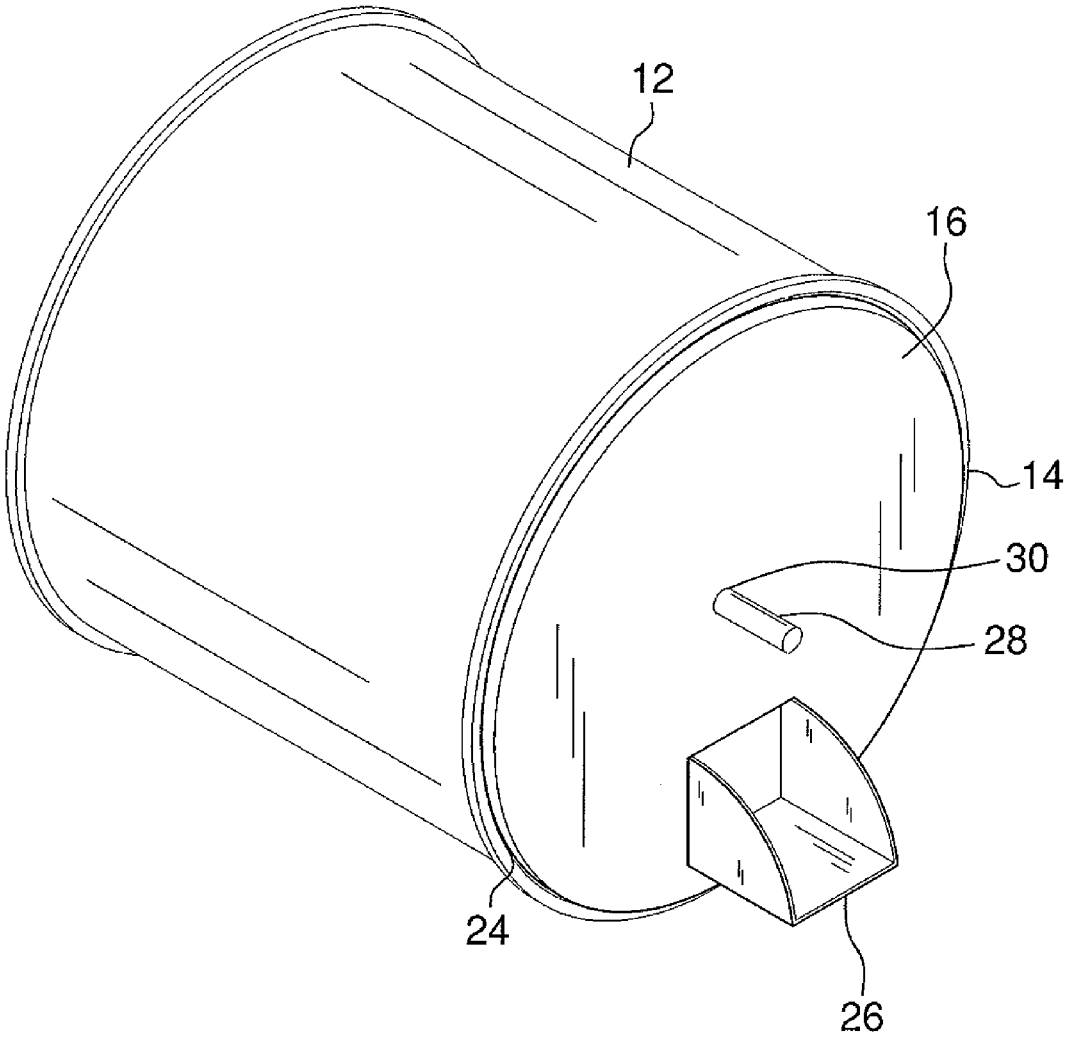
FIG. 7 is a front side view of an embodiment of the disclosure.

With reference now to the drawings, and in particular to FIGS. 1 through 7 thereof, a new mixer embodying the principles and concepts of an embodiment of the disclosure and generally designated by the reference numeral 10 will be described.

As best illustrated in FIGS. 1 through 7, the fluid mixing apparatus 10 generally comprises a circular lid 16 for engaging an open top 14 of a cylindrical container 12, such as a conventional paint can or a five-gallon paint bucket. The lid 16 has a top side 18, a bottom side 20, a center and a perimeter edge 24. Adjacent the perimeter edge 24, the lid 16 has a spout 26 opening that extends through into the top side 18 and outwardly of the bottom side 20 to permit fluid to be poured from the container 12.

A shaft 28 is rotatably positioned through the lid 16 for rotation about a shaft axis. The shaft 28 extends through an aperture 30 at the center of the lid 16. The shaft 28 has a proximal end 32 and a distal end 34 with respect to the lid 16 in which the proximal end 32 extends upwardly above the top side 18. The proximal end 32 has a handle engaging portion 36 that can engage a handle 38 or a power tool chuck. The length of the shaft 28 may range from approximately 7 inches to approximately 32 inches, or may be approximately 9.5 inches. The length of the shaft 28 may vary depending on the height of the container 12. For example, in a conventional paint can, an approximately 9.5 inch long may be employed. In a conventional five-gallon paint bucked, however, a shaft 28 having a length of approximately 24 to 32 inches may be employed.

A mixer 40 is attached to the shaft 28 adjacent the distal end 34 for rotating with the shaft 28 in a plane that is perpendicular to a longitudinal axis of the shaft 28 extending through the proximal and distal ends. The mixer 40 has a front surface 42, a back surface 44, a top side 46, a bottom side 48, and two lateral sides 50. The top side 46 has an aperture 30 that removably receives the shaft 28. Legs 54 are attached to the bottom side 48 of the mixer 40, extending downwardly adjacent the lateral sides 50. The mixer 40 has a length defined by a distance between the lateral sides 50. The length may be between approximately 4 inches and 7 inches. The mixer 40 has a fixed portion 56 and a hinged portion 58 hingedly connected to the fixed portion 56 for adjusting the length. The hinged portion 58 is movable between a first position and a second position to alter the length between a first length and a second length. The first length may be from approximately 3 inches to 6 inches, or approximately 4.375 inches. The second length may be from approximately 5 to 7 inches, or approximately 6.375 inches.

An agitator 60 is mounted to the shaft 28 for agitating a fluid when the apparatus 10 is mounted in a container 12. The agitator 60 is located between the handle engaging portion 36 and the mixer 40, and can be selected from a variety of agitator 60 configurations. In one configuration, the agitator 60 includes a plurality of U-shaped blades 62 attached to and extending radially outward from the shaft 28 so that the mixer 40 has a U-shaped cross-section taken perpendicular to a longitudinal axis of the mixer 40 extending through the lateral sides 50. In another configuration, the agitator 60 may include a plurality of paddles 64 having a substantially rectangular shape and a chamfer. The paddles 64 may have a configuration of apertures therein for agitating liquid as the agitator 60 is rotated within a liquid.

In use, the apparatus 10 is engaged to the open top 14 of a container 12 (e.g., a conventional paint container 12) and a manually actuated or a powered rotating device rotates the shaft 28 on the shaft axis, and the mixer 40 and agitator 60 attached thereto. This rotation causes agitation in the fluid (e.g., paint) and the fluid is mixed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A fluid mixing apparatus configured to mix fluid in a cylindrical container having an open top, said apparatus comprising:

a circular lid for engaging said open top;

a shaft being rotatably positioned through said lid, said shaft being rotatable about a shaft axis, said shaft extending through an aperture at said center of said lid, said shaft having a proximal end and a distal end with respect to said lid, said proximal end extending upwardly above said top side, said proximal end having a handle engaging portion;

a mixer being attached to said shaft adjacent said distal end rotating with said shaft in a plane perpendicular to a longitudinal axis of said shaft extending through said proximal and distal ends, said mixer having a front surface, a back surface, a top side, a bottom side, and two lateral sides, said top side having a mixer aperture removably receiving said shaft, said mixer having legs attached thereto and extending downwardly from said bottom side adjacent said lateral sides, said mixer having a length defined by a distance between said lateral sides, said length being adjustable, said mixer having a fixed portion and a hinged portion hingedly connected to said fixed portion; and an agitator being mounted to said shaft for agitating a fluid when said apparatus is mounted in a container.

2. The apparatus according to claim 1, further comprising a handle being removably engageable with said handle engaging portion.

3. The apparatus according to claim 1, wherein said lid has a top side, a bottom side, a center and a perimeter edge, said lid having a spout opening adjacent to said perimeter edge and extending through into said top side and outwardly of said bottom side, said spout configured to permit fluid to be poured from said container.

4. The apparatus according to claim 1, wherein a power tool chuck is engageable with said handle engaging portion.

5. The apparatus according to claim 1, wherein said hinged portion is movable between a first position and a second position to alter said length between a first length and a second length.

6. The apparatus according to claim 1, wherein said agitator is mounted between said handle engaging portion and said mixer, said agitator comprising a plurality of U-shaped blades attached to and extending radially outward from said shaft.

7. The apparatus according to claim 1, wherein said agitator is mounted between said handle engaging portion and said mixer, said agitator comprising a plurality of paddles, said paddles having a substantially rectangular shape.

8. The apparatus according to claim 7, wherein said paddles have a plurality of apertures therein.

9. The apparatus according to claim 7, wherein said paddles have a chamfer.

10. A fluid mixing apparatus configured to mix fluid in a cylindrical container having an open top, said apparatus comprising:

a circular lid for engaging said open top, said lid having a top side, a bottom side, a center and a perimeter edge, said lid having a spout opening adjacent to said perimeter edge and extending through into said top side and outwardly of said bottom side, said spout configured to permit fluid to be poured from said container;

a shaft being rotatably positioned through said lid, said shaft being rotatable about a shaft axis, said shaft extending through an aperture at said center of said lid, said shaft having a proximal end and a distal end with respect to said lid, said proximal end extending upwardly above said top side, said proximal end having a handle engaging portion, wherein a power tool chuck is engageable with said handle engaging portion;

a handle being removably engageable with said handle engaging portion;

a mixer being attached to said shaft adjacent said distal end rotating with said shaft in a plane perpendicular to a longitudinal axis of said shaft extending through said proximal and distal ends, said mixer having a front surface, a back surface, a top side, a bottom side, and two lateral sides, said top side having a mixer aperture removably receiving said shaft, said mixer having legs attached thereto and extending downwardly from said bottom side adjacent said lateral sides, said mixer having a length defined by a distance between said lateral sides, said length being adjustable, said mixer having a fixed portion and a hinged portion hingedly connected to said fixed portion, said hinged portion being movable between a first position and a second position to alter said length between a first length and a second length; and an agitator being mounted to said shaft for agitating a fluid when said apparatus is mounted in a container, said agitator mounted between said handle engaging portion and said mixer, said agitator comprising a plurality of U-shaped blades attached to and extending radially outward from said shaft.

* * * * *